United States Patent [19]

Linder

[11] Patent Number: 5,057,282

[45] Date of Patent: Oct. 15, 1991

[54] PIPETTE UNITIZER AND SHIPPER

[75] Inventor: Alan J. Linder, Waukesha, Wis.

[73] Assignee: Waldorf Corporation, St. Paul, Minn.

[21] Appl. No.: 558,582

[22] Filed: Jul. 27, 1990

[51] Int. Cl.[5] ..... B01L 3/00; B65D 5/00

[52] U.S. Cl. ..... 422/104; 422/99; 206/562; 206/563; 206/366; 206/369; 206/370; 206/45; 229/915; 229/DIG. 11; 220/507; 220/510

[58] Field of Search ..... 422/99, 104; 206/562, 206/563, 366, 369, 370; 229/915, DIG. 11; 220/507, 510

[56] References Cited

U.S. PATENT DOCUMENTS

| | | | |
|---|---|---|---|
| 1,101,479 | 6/1914 | Osdel | 229/DIG. 11 X |
| 2,583,673 | 1/1952 | Storey | 229/DIG. 11 X |
| 3,006,523 | 10/1961 | Keith | 229/915 X |
| 3,390,783 | 7/1968 | Quackenbush, Jr. | 206/562 X |
| 3,682,597 | 8/1972 | Husch | 422/104 X |

FOREIGN PATENT DOCUMENTS

| | | | |
|---|---|---|---|
| 0553419 | 12/1958 | Italy | 206/562 |
| 7705945 | 12/1977 | Netherlands | 229/915 |
| 2040884 | 9/1980 | United Kingdom | 229/DIG. 11 |

*Primary Examiner*—Robert J. Warden
*Assistant Examiner*—Stephanie Blythe
*Attorney, Agent, or Firm*—Dorsey & Whitney

[57] ABSTRACT

A package for unitizing and shipping pipette tips is provided and includes a paperboard tray received on the side panels of an outer shipping enclosure, which panels support the tray over a cavity into which the pipette tips extend. The tray includes two spaced, substantially parallel panels, each having an array of holes; the arrays are aligned. One of the parallel panels is preferably joined to the tray along perforated, cut fold lines, whereby that panel easily may be broken away from the tray when the tray is placed on a pipette support block. The invention also encompasses flat blanks, one for the tray and one for the shipping enclosure, for forming into the package.

20 Claims, 5 Drawing Sheets

64
66
54
62
52
68
82
84
90
86
85
94
92

66
64
54
100
62
96
52
68
94
90
82
84
85
92

50
80
74
78
96
76
70
52
68
94
84
86
93
92
60
58
82
90
66
64
62
54
56

PIPETTE UNITIZER AND SHIPPER

The present invention relates to laboratory equipment, including packaging suitable for laboratory equipment. More particularly, the present invention relates to a package in which laboratory equipment such as pipette tubes or tips may be packaged, shipped and used at the point of use.

BACKGROUND OF THE INVENTION

In recent years, demand for chemical analysis and laboratory testing has increased. Two areas in which there have been substantial increases include disease related testing (AIDS testing and research) and drug testing for various employees. These demands have created the need for an efficient, economical, simple and disposable container for transporting laboratory equipment and improving the efficiency and ease with which laboratory operations can be carried out. Often these laboratory operations are carried out with mass samples arrayed in test blocks. Usually the individual samples are contained in separate pipettes, each of which undergoes certain common procedures.

It is known in the prior art to use paperboard cartons in various forms to package and ship laboratory equipment. With specific regard to pipettes, test tubes or pipette tubes or tips, a number of cartons have been used wherein a paperboard tray having an array of holes is received in an outer packaging carton.

Although commercially available cartons and methods for packaging pipettes or pipette tips have improved, there are some problems which have remained unaddressed. One such problem is providing a package or packaging method which reduces and minimizes damage to pipette tips during shipment. Another problem is that it is difficult to maintain the pipettes or pipette tips in clean or sterile condition during shipment and, after arrival, during use. Handling of the pipette tips after their arrival at the point of use should be minimized; it is highly inefficient when a single pipette tip must be removed from the package in which it arrived and placed in a laboratory pipette tip rack. In addition each incident of handling increases the chance of contamination in sensitive procedures. With current packaging methods, stability, efficiency and safety are not enhanced to an optimum degree. Accordingly, there is a need for a simple, safe, efficient, disposable paperboard package for pipette tips.

SUMMARY OF THE INVENTION

In accordance with the present invention, a package for unitizing and shipping pipette tips is provided. The package comprises a paperboard tray or cage received in an outer shipping box. The tray includes at least two spaced parallel panels, each having an array of holes; the arrays are aligned and the parallel panels are joined by sidewalls between them. At the perimeter of the lower of the two parallel panels, where that lower panel is attached to the sidewalls of the tray, the tray is provided with perforations or other frangible connections whereby the lower panel may be easily broken away from the remainder of the tray. The invention also encompasses flat blanks, one for the tray and one for the shipping box, for forming into the package.

An important objective of the present invention is to provide a convertible pipette tip package for both shipping and point of use purposes.

Another object of the present invention is to provide a package for shipping pipette tips whereby, during shipping, damage to the pipette tips contained in the package will be reduced.

Yet another object of the present invention is to provide a pipette tip unitizing and shipping container wherein an external wrapping or shipping portion of the container may be disposed of at the point of use and an inner or tray portion of the package may be used to transfer efficiently a plurality of pipette tips to a work site.

A further object of the present invention is to provide a simple, unitary paperboard tray or cage for supporting a plurality of pipette tips in a laboratory environment so that a lab technician or worker can easily install in one operation a large array of pipette tips supported by the package of the present invention in a test block or similar fixture used for mass testing.

An important advantage of the present invention is that it combines specific shipping and packaging advantages, such as reduced breakage and rigidity, with specific point of use advantages such as enhanced stability and ease of use.

Other advantages of the present invention are that it can be used with suitable supplemental packaging means, such as thermoplastic shrink-wrap or other wrappings, to securely ship sterile pipette tips. Even though the present invention serves to reduce breakage of the pipette tips during shipping, it provides for easy withdrawal of pipette tips at the point of use. Additionally, the pipette shipping and unitizing container of the present invention may be used for various sized pipette tips without substantial redesign or reconfiguration of the package. Nevertheless, the package may be easily reconfigured to ship other generally tubular shaped items such as test tubes, small vials, or syringes or needles.

Other objects and advantages of the present invention will become more fully apparent and understood with reference to the following specification and to the appended drawings and claims.

DETAILED DESCRIPTION OF THE PREFERRED EMBODIMENT

Figure 1:
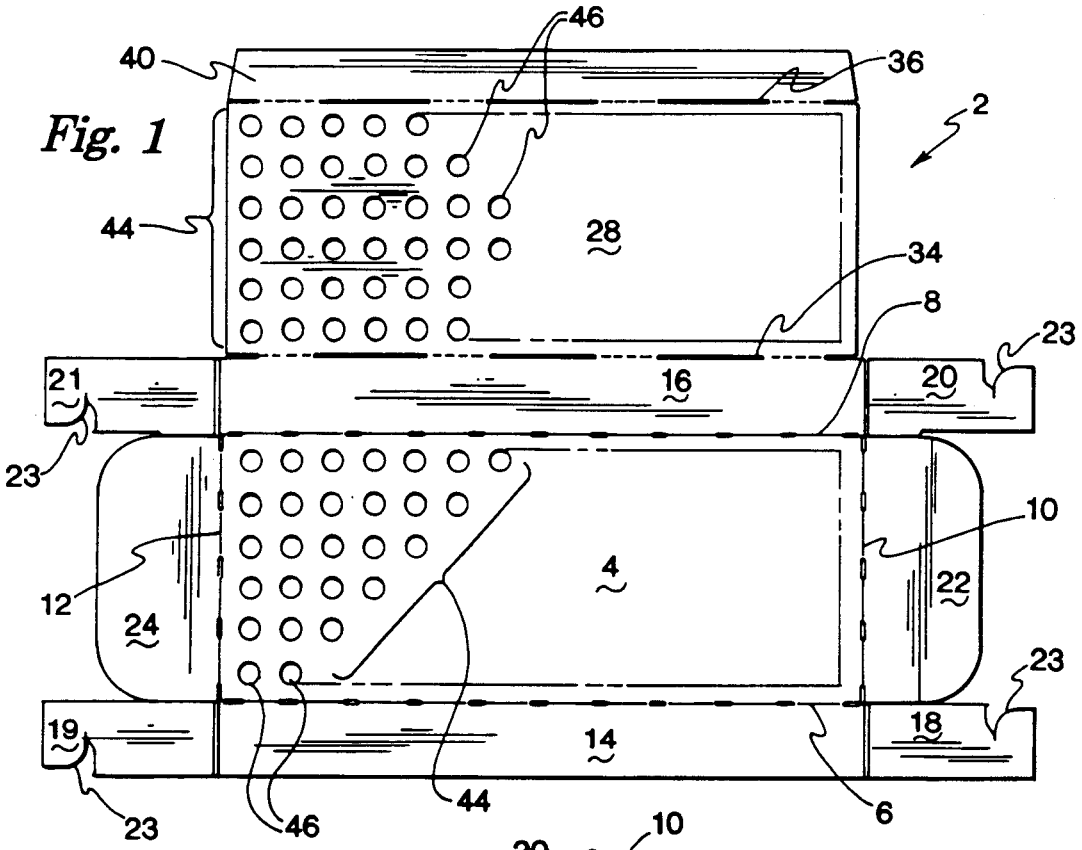
FIG. 1 is a top plan view of the blank from which the pipette tray of the present invention may be formed and shows the die-cut profile thereof.

As shown in FIG. 1, a blank 2 in accordance with the present invention has a first (or upper) generally rectangular array holding panel 4 formed and defined by perforated and scored fold lines 6, 8, 10, 12 that define two pairs of parallel, opposed perimeter edges for panel 4. (In the drawings, double lines indicate fold lines and single solid lines indicate cuts, scores, or free edges.) Two opposed, substantially rectangular side panels 14, 16 are secured to the first array panel 4 at opposed, parallel fold lines 6, 8. Each of the side panels 14, 16 has a pair of locking end tabs 18, 19 and 20, 21 respectively, foldably attached thereto at opposed, parallel end fold lines oriented perpendicular to fold lines 6, 8; each locking end tab has a hook end 23. Two end guide flaps 22, 24 are foldably attached to the first array panel 4 at opposed, parallel perforated and scored fold lines 10, 12, respectively, oriented perpendicular to fold lines 6, 8.

The blank 2 includes a second (or lower) generally rectangular array holding panel 28. Like first array panel 4, panel 28 has two pairs of parallel, opposed perimeter edges. The second array panel 28 is attached to the side panel 16 at a perforated and cut fold line 34. At the opposite side of the panel 28, opposed, parallel perforated fold line 36 is provided between a glue flap 40 and the second array panel 28. For reasons made clearer below, each of the fold lines 34, 36 is perforated and cut so that the material at the fold lines 34, 36 forms a sequence of frangible connections that can be broken relatively easily to separate the second array panel 28 from the side panel 16 and the glue flap 40.

Each of the first array panel 4 and the second array panel 28 is provided with an array 44 of a plurality of through holes or openings 46. The array 44 preferably covers essentially the entire surface of each panel 4, 28, but for simplicity only a portion of each array is depicted in FIG. 1. The openings may be uniformly of a selected diameter as shown or may be a mix of various diameters (not shown). The openings 46 forming the array 44 on the first and second array holding panels 4, 28 are preferably aligned, whereby each of the centers of the openings 46 on the panel 4 may be placed in vertical alignment with centers of the correspondingly-positioned openings 46 in the panel 28. The openings 46 on the second panel 28 may have an enlarged diameter relative to the openings 46 on the first panel 4.

Figure 2:
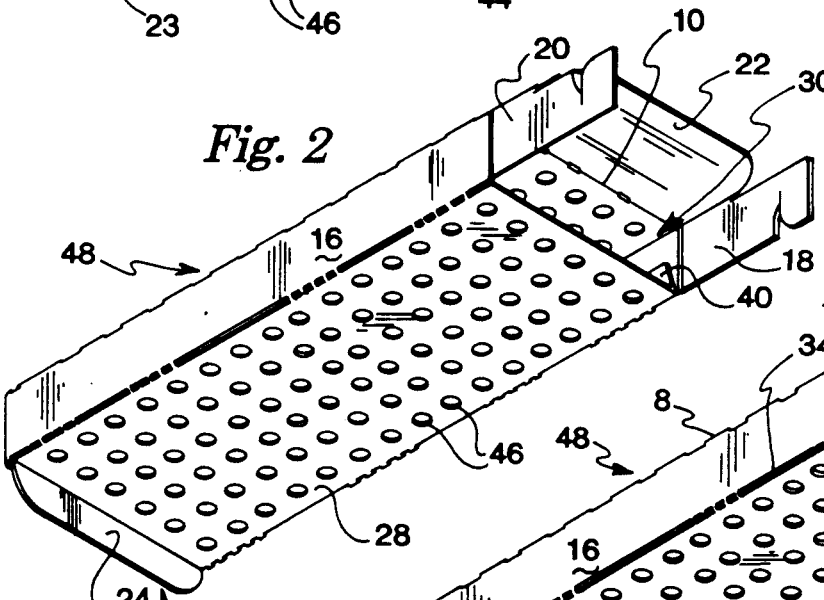
FIG. 2 is a perspective view showing partial assembly of the tray.
Figure 3:
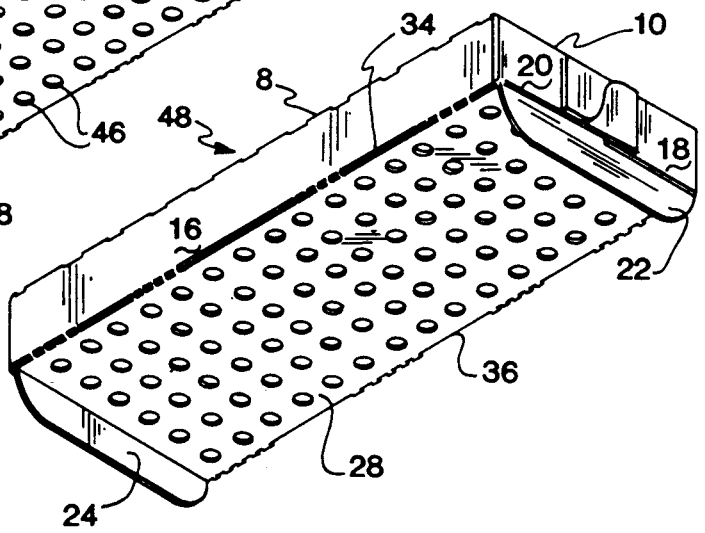
FIG. 3 is a perspective view showing assembly of the tray completed.

With regard to the assembly or erection of the blank 2, a completed tray or container 48 formed from the blank 2 is shown in FIG. 3, and FIG. 2 shows a partially completed container 48. To form the container 48, the blank 2 is folded about the parallel, perforated fold lines 6, 8, 34 and 36 so that the first panel 4 and the second panel 28 are placed into parallel relationship with their perimeter edges aligned, with the second array holding panel 28 being beneath or lower than the first array holding panel 4 and the panels 4, 28 being spaced from one another by a distance equal to the width of the side panels 14 and 16. (While it is preferred that the panels 4,28 are substantially planar and parallel, it is clear that by varying the shape of the side panels 14, 16, to make them triangular, for example, it would be possible to have panels 4, 28 diverge from each other toward one end of the tray 48 or diverge from the ends to meet in the center, such that the panel 28 would no longer be planar and would point downward from a center fold line.) The glue flap 40 is secured to the inside (or outside) of the side panel 14 by suitable adhesive or glue (not shown) to make a composite side panel. At this point the container 48 has assumed the configuration substantially as depicted in FIG. 2. The various holes 46 of the array of holes 44 in panels 4 and 28 are vertically aligned. To close the ends 30, 32 of the container 48, the end guide flaps 22, 24 are folded downward about the fold lines 10, 12 until reaching a position as shown in FIG. 3. The tray container 48 is completed by folding the paired locking end tabs 18, 20 and 19, 21 inwardly toward the flaps 22, 24 and connecting the respective pairs, specifically, interlocking their hook-shaped ends 23. Thus, each end 30, 32 has a set of interengaging end flaps. The various flaps and panels which are brought into overlying contacting relationship may be secured by various suitable adhesives or by frictional interlocks such as slotted locking tabs shown. That is, for example, the locking tabs 18, 20, 19, 21 could be replaced by plain tabs, with the respective pairs 18, 20 and 19, 21, being connected by glued ends.

FIG. 3 shows one of the advantages provided by the container or tray 48. It should be appreciated that the guide flaps 22, 24 extend past the panel 28 and, therefore, may act as supports or "legs" for supporting the container 48 in a balanced, free-standing condition when relatively short pipettes are used. As will be seen in greater detail below, another advantage provided by the guide flaps 22, 24 is that they serve as guides or stops for positioning the tray 48 on the erected base enclosure receptacle 100 of FIG. 7.

Figure 6:
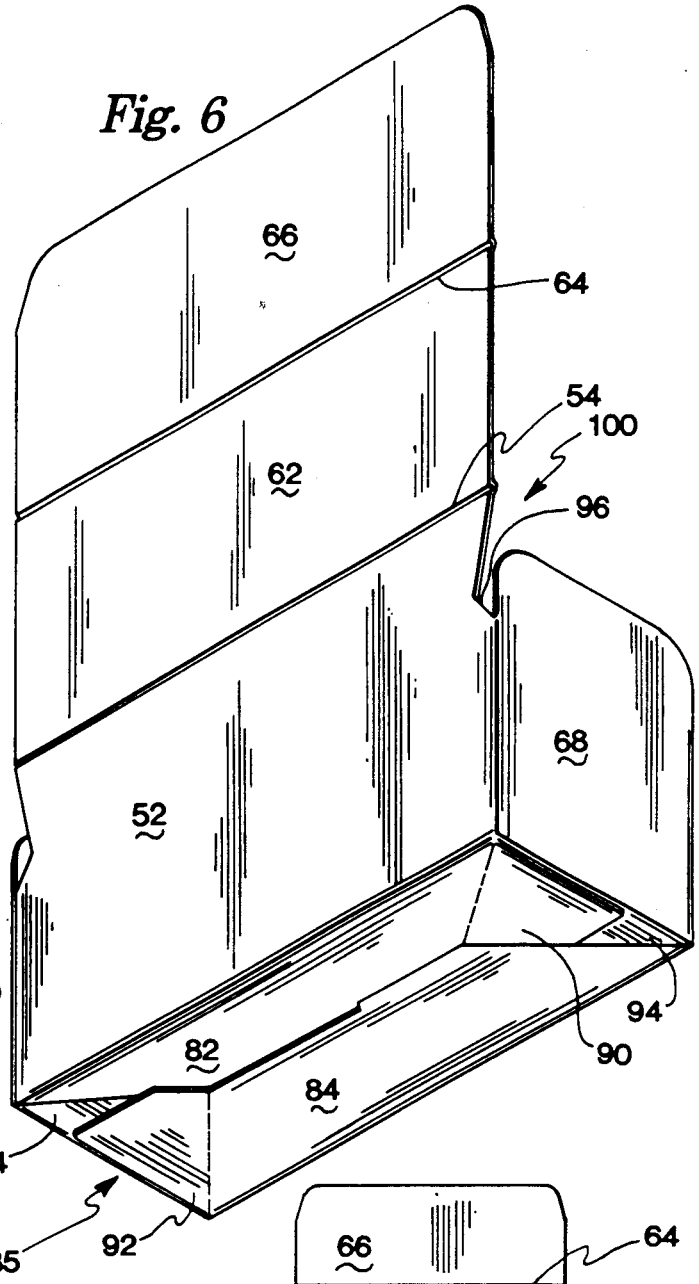
FIG. 6 is a perspective view showing the shipping box assembly with the bottom erected.
Figure 4:
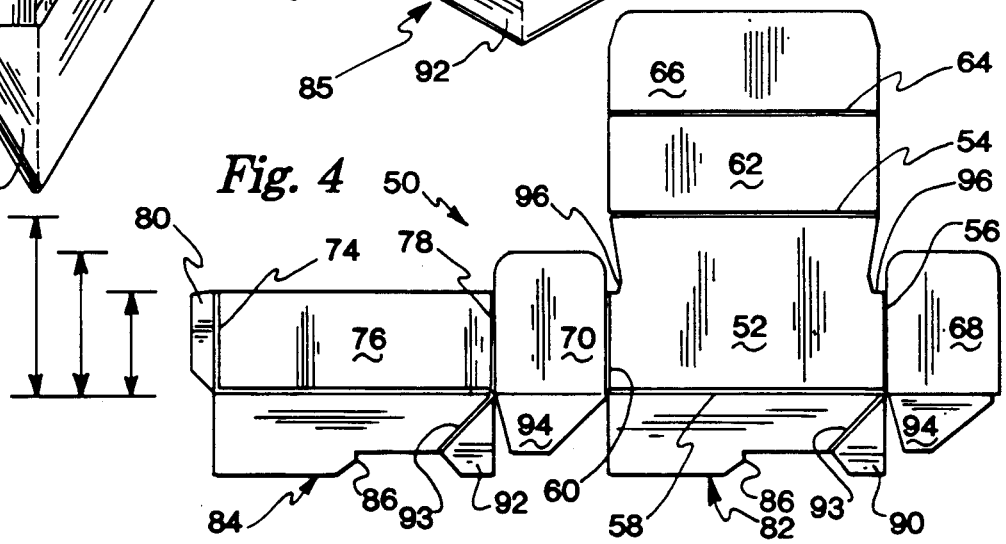
FIG. 4 is a top plan view of the blank from which the shipping box of the present invention may be formed and shows the die-cut profile thereof.

FIG. 4 shows a blank 50 for forming into the completed shipping or base enclosure receptacle 100 shown in FIG. 6. This receptacle 100 forms the second part of the two part container shown more fully in FIGS. 7–17. The blank 50 includes a central back panel 52 having its edges defined by four nonperforated fold or score lines 54, 56, 58 and 60. Lines 54, 58 are straight and parallel; lines 56, 60 are straight but have associated irregular cuts forming notches 96. Along one of the straight lines 54, a top closure flap 62 is connected to the central back panel 52. One edge of the top closure flap 62 is defined by a fold line 64, parallel to fold line 54, which connects a front closure flap 66 to the top closure flap 62. Side panels 68, 70 are joined to the central back panel 52 at fold lines 56 and 60, respectively.

At fold line 78, on the opposite side of the side panel 70 from fold line 60, a front panel 76 is attached to the side panel 70. Fold line 78 is an unperforated fold or score line and is parallel to fold line 60. A glue flap 80 is provided at the end of the front panel 76 opposite fold line 78; the glue flap 80 is attached to the front panel 76 at a fold line 74 parallel to fold line 78.

Bottom forming half flaps 82, 84 are provided for constructing the base panel or bottom portion 85 of the shipping receptacle 100. Half flap 82 is connected to panel 52 at fold line 58. Half flap 84 is connected to panel 76 at an extension of fold line 58. Each half flap 82, 84 is provided with notched portions 86. A bottom glue flap 90, 92 is attached to each of the half flaps 82, 84, respectively, at diagonal perforated fold or score lines 93, 93. An interior closure flap 94, 94 is foldably connected to each of the side panels 68, 70 at a fold line that is an extension of fold line 58.

Three particular disparate widths or heights, $H_1$, $H_2$, $H_3$, are provided in the blank 50 as shown in FIG. 4. The central back panel 52 has a height $H_1$; the side panels 68, 70 are depicted as having height $H_2$; and the front panel 76 is depicted as having a height $H_3$. Additionally, a pair of lateral tray receiving notches 96 are provided in the central back panel 52. The purpose and function of the disparate heights and the notches 96 will be explained herein below.

Figure 5:
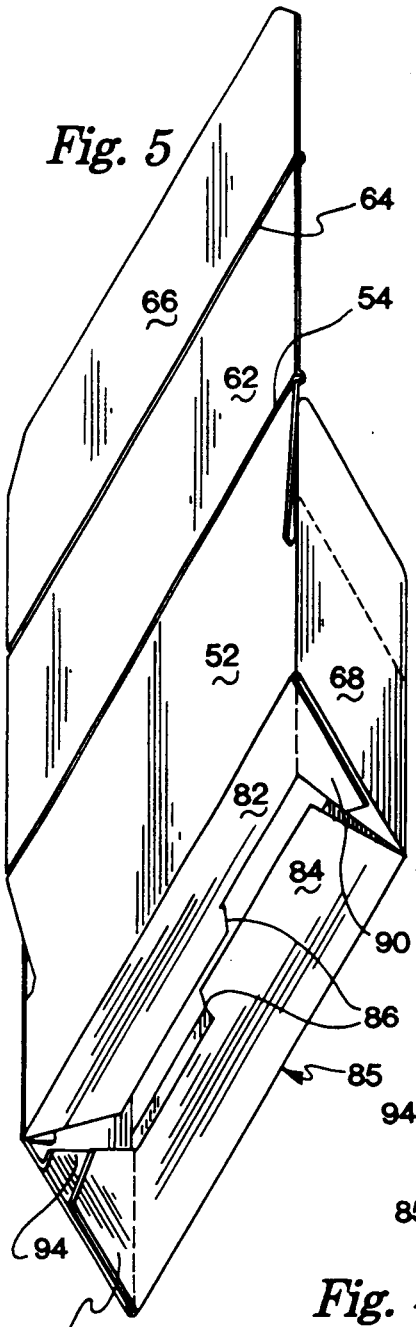
FIG. 5 is a perspective view showing the shipping box partially assembled.

For the assembly or folding erection of the blank 50 into the completed base enclosure receptacle 100, the blank 50 first is folded one hundred eighty degrees along fold line 58 (including its extensions across the blank 50) so that bottom forming half flaps 82, 84 and interior closure flaps 94, 94 lie against panels 76, 70, 52 and 68. Bottom glue flaps 90, 92 are then reverse folded one hundred eighty degrees along lines 93, 93 to lie on the respective half flaps 82, 84 with which they are associated and glue is applied to the exposed side of each flap 90, 92. Next, front panel 76 together with glue flap 80 is folded one hundred eighty degrees at fold line 78 to lie on panels 70 and 52 and on the interior closure flap 94 folded onto panel 70. The glue on bottom glue flap 92 then contacts the interior closure flap 94 folded onto panel 70. Glue is applied to the exposed side of glue flap 80, and panel 68 together with associated interior closure flap 94 is then folded one hundred eighty degrees at fold line 56 onto panel 56 and into contact with glue flap 80 and bottom glue flap 90. When the flattened blank is permitted to expand such that the angles between panels 76, 70, 52 and 68 are ninety degrees, the half flaps 82, 84 are forced downward to form a base panel 85. The notched portions 86 of the half flaps 82, 84 are brought into cooperative alignment to form the tight, locked configuration of a base panel 85 as shown in FIG. 6. This is facilitated by temporarily skewing the otherwise generally rectangular box shape of receptacle 100 in the manner shown in FIG. 5, so that the flaps 82, 84 can be positioned, then the resilience of the box material tends to drive the notched portions 86 into interlock. While this interlocked panel configuration is preferred, it is clear that the receptacle 100 could also be formed with a conventional machine-glued seal-end bottom or with a different form of hand-assembled bottom.

Figure 7:
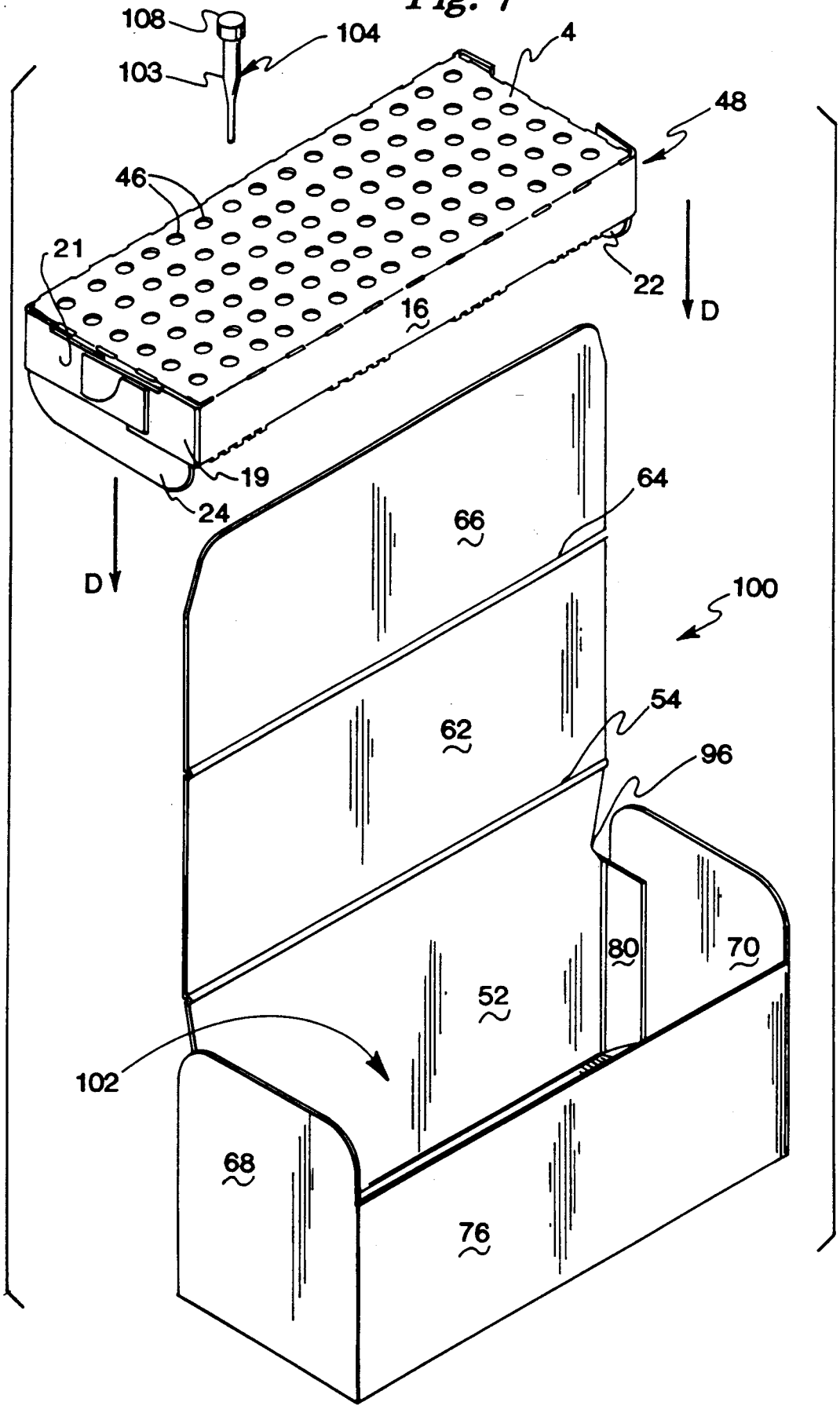
FIG. 7 is an exploded perspective view showing the pipette tray aligned for insertion onto the shipping box.
Figure 8:
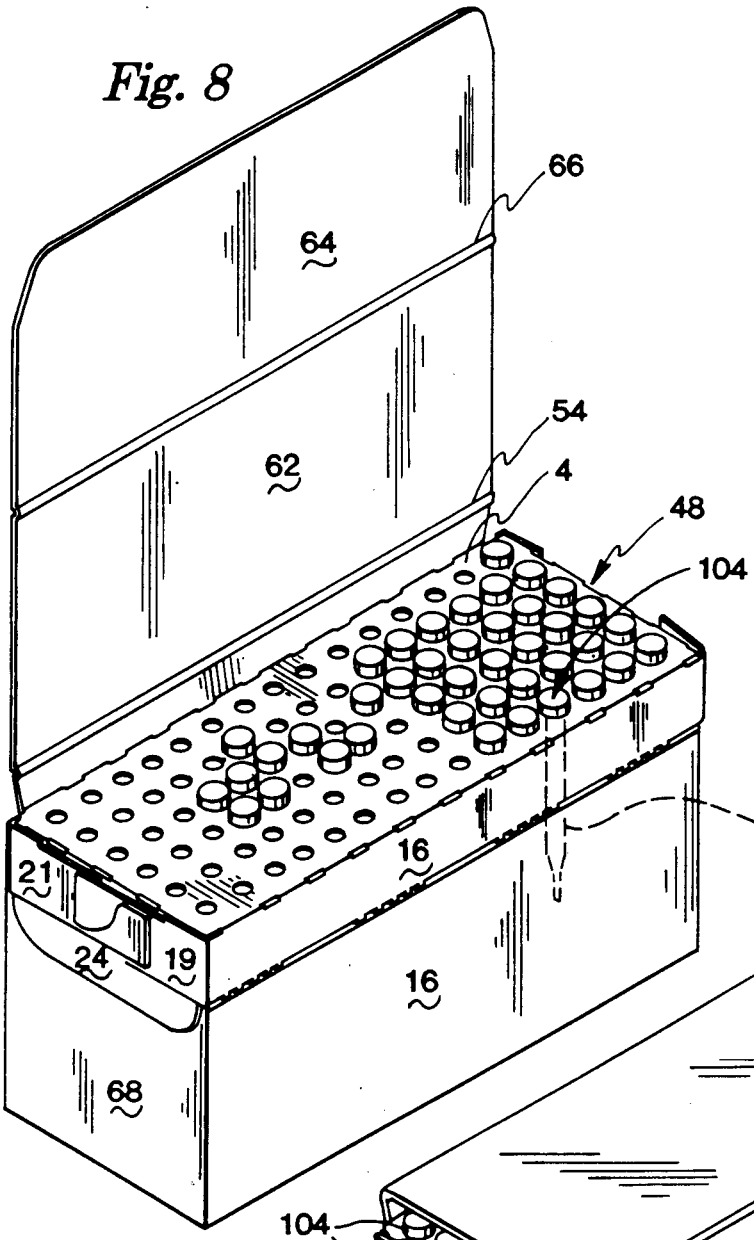
FIG. 8 is a perspective view showing the pipette tray inserted onto the shipping box.
Figure 9:
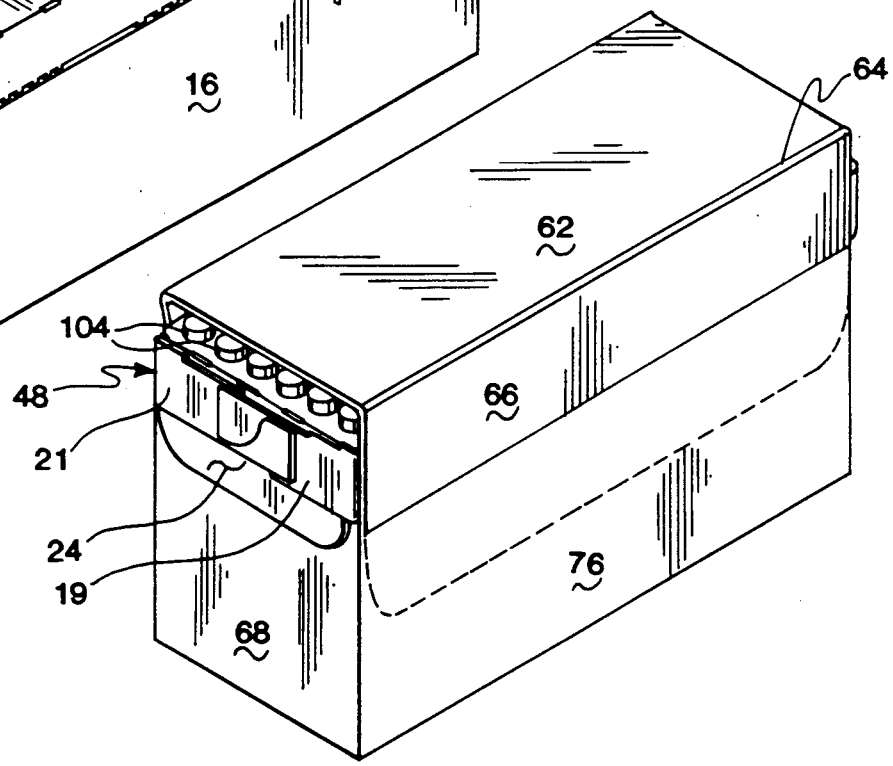
FIG. 9 is a perspective view showing the pipette tray and shipping box in completed assembly.

FIG. 7 shows a completed container or tray 48 and a completed shipping base enclosure 100 as they would be aligned for receiving items to be shipped. A pipette tip 104 is shown as it would be aligned with the container 48 and the aligned holes 46 therein. The shipping enclosure 100 defines a pipette tip receiving cavity 102 with side panels 68, 70 positioned to serve as support flaps supporting the ends of tray 48. FIGS. 7, 8 and 9 show a typical packaging sequence. In FIG. 7, a pipette tip 104 is aligned with a hole 46 for placement into the container 48. In practice, the container 48 would be filled with pipette tips 104 only after it has been moved in the direction D indicated and placed on top of the enclosure 100 in the position shown in FIG. 8.

One of the advantages of the present invention, increased rigidity and stability, particularly with regard to the shipping form, is made evident in FIG. 8. Each end guide flap 22, 24 of tray 48 lies outside of and is in frictional contact with the adjacent side panels 70, 68, respectively, of the shipping enclosure 100, thereby forming at least a partial double-wall. The overlying relationship is enabled by the open opposed ends 30, 32 of the container 48 covered by sets of interengaging flaps 18, 20, 22 at one end and 19, 21, 24 at the other end (see FIGS. 1 and 2), the notches 96 and by the three different heights $H_1$, $H_2$, $H_3$ of the walls or panels (see FIG. 4) comprising the enclosure 100. The elongated body 103 of each pipette tip 104 extends through the space between the first panel 4 and the second panel 28 and into the pipette receiving cavity 102.

FIG. 9 shows the completed carton or package in accordance with the present invention ready for shipping. Specifically, following the insertion of the container 48 into position on the shipping enclosure 100, the top closure flap 62 and the front closure flap 66 have been brought forwardly and folded along fold lines 54 and 64 so that the top closure flap 62 overlies the pipette tips 104 in close relation and so that the front closure flap 66 may be tucked in behind (or, alternatively, affixed to) the front panel 76. The container 48 is stably held in position over the cavity 102 by the support of the upper edges of side panels 68, 70, which engage the lower surface of the first array holding panel 4 adjacent fold lines 10, 12, just inside end guide panels 22, 24. The closure flap 66 is held in place by its friction fit behind the front panel 76 or, in the alternative, various adhesives, interlocking tab methods or other suitable means may be used to securely close the completed package shown in FIG. 9. Additionally, various appropriate wrapping materials such as thermoplastic films may be used to completely seal or wrap the completed package for special applications, for example, where it may be necessary to package and ship sterile pipette tips 104. In one variation, the top and front closure flaps 62, 66 are omitted and the height of back panel 52 is reduced to leave an open-topped receptacle 100 (not shown) that can be shrink-wrapped with a clear plastic film, permitting easy visual inspection of the cleanliness of the enclosed pipette tips 104.

Figure 10:
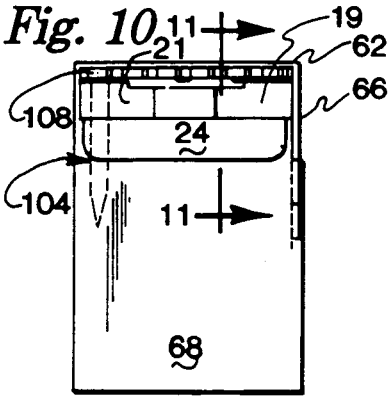
FIG. 10 is a left side elevational view of the completed assembly.
Figure 11:
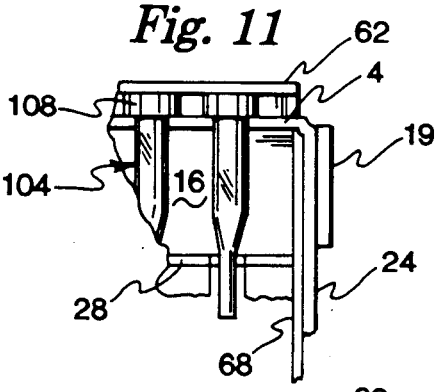
FIG. 11 is a front fragmentary sectional view along line 11—11 of FIG. 10.

FIGS. 10 and 11 provide additional details with regard to the package 106 shown in FIG. 9. FIG. 10 shows the close overlying relationship between the upper end 108 of the pipette tips 104 and the top closure flap 62; this relationship securely holds the tips 104 in their proper place and minimizes breakage. FIG. 11 shows how the combination of the container 48 and the shipping enclosure 100 reinforces the upper edge 110 of the shipment box 106. Specifically, each side panel 68, 70 extends upwardly in a frictional contacting relationship inside the adjacent end guide flaps 22, 24. The additional layer forming a triple thickness at upper edge 110 in FIG. 11 is created by the two pairs of opposed locking tabs 19, 21, with tabs 18, 20 forming a similar structure (not shown in FIG. 11) at the other end of the container 48.

Figure 12:
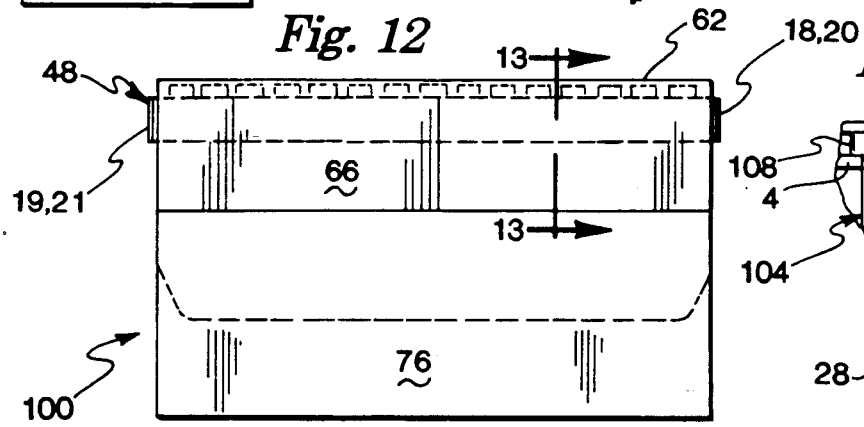
FIG. 12 is a front elevational view of the package of the present invention.
Figure 13:
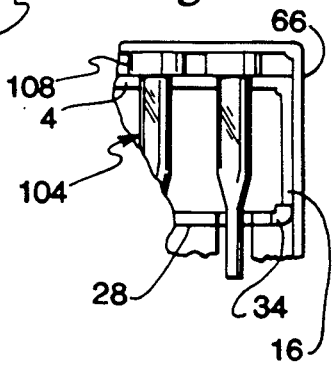
FIG. 13 is a right side fragmentary sectional view along line 13—13 of FIG. 12.

FIGS. 12 and 13 show a front view of the package 106 and, specifically, how the front closure flap 66 is tucked behind the front panel 76 of the container 48. The interlocking tabs 18, 20 and 19, 21 provide assistance in the removing the container 48 from the shipping enclosure 100 by providing a place where the container 48 containing pipette tips 104 may be grasped for removal from the enclosure 100. In this way an entire array of pipette tips 104 can be removed in one operation.

Figure 14:
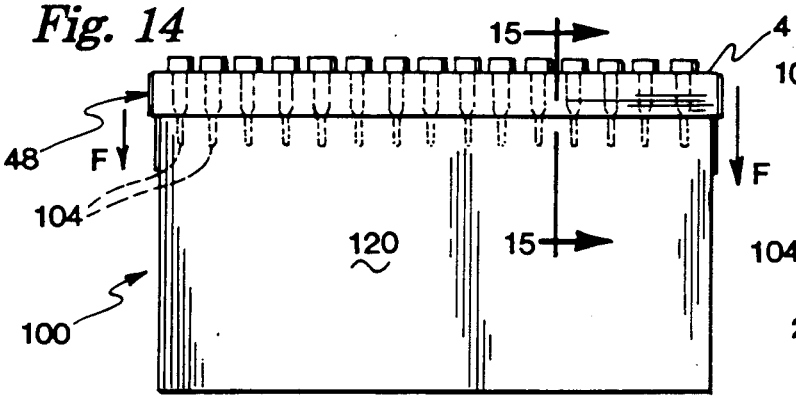
FIG. 14 is a front elevational view of the tray of the present invention in use with a pipette rack.
Figure 15:
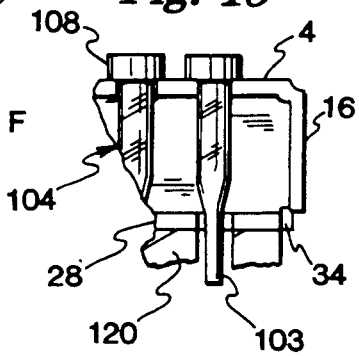
FIG. 15 is a fragmentary sectional view along line 15—15 of FIG. 14.

FIGS. 14 through 17 illustrate additional important advantages provided by the preferred embodiment of the present invention. FIG. 14 shows a pipette tip or test block or support 120; such supports frequently are used in the laboratory environment for mass handling of pipette tips. As seen in FIGS. 14 and 15, the container 48 has been removed from the shipping enclosure 100 and placed on the flat upper surface of the pipette support 120. It should be appreciated that the support 120 is provided with a plurality of apertures for accommodating the elongated bodies of the pipette tips 104, which apertures match the array of pipette tips 104 in the container 48. FIG. 15 shows how the pipette tip container 48 rests upon the pipette support 120; the elongated body 103 of a pipette tip 104 extends into the support 120. Thus, it will be seen that the container 48 provides a convenient means for installing the entire array of pipette tips 104 in the support 120 in one operation.

FIG. 15 also shows the frangible, perforated fold line connections at fold line 34 connecting the second, lower panel 28 to the sidewall 16. Similar frangible connections exist at fold line 36. Because the second, lower panel 28 is frangibly connected to the side panel 16 and glue flap 40, the side panels 14, 16 and glue flap 40 together form collapsible spacing means that hold the upper and lower panels 4, 28 in aligned, spaced relation unless and until the frangible connections are broken. Arrows F, shown in FIG. 14, are provided to show the direction in which laboratory personnel may exert force on the completed container 48 in order to break the frangible connections and achieve another of the advantages of the present invention.

Figure 16:
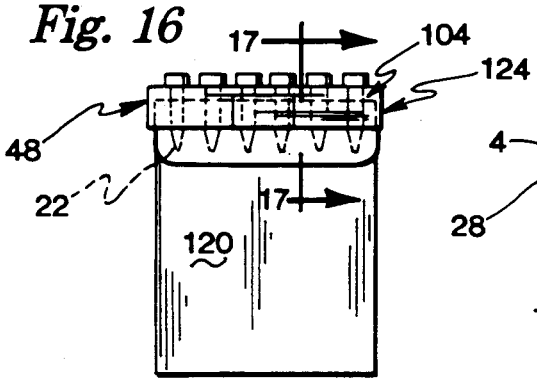
FIG. 16 is a side elevational view of the tray of the present invention following the point of use manipulation of the present invention as explained herein.
Figure 17:
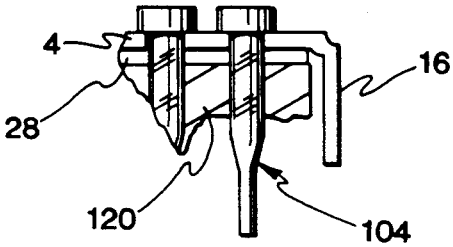
FIG. 17 is a fragmentary sectional view along line 17—17 of FIG. 16.

Specifically, force exerted on the container 48 in the direction F will move the first, upper panel 4 of the container 48 and the various pipette tips 104 into closer relation with the pipette support 120, as shown in FIG. 16. A force exerted in the direction F will cause the frangible, cut fold lines 34, 36 connecting the second, lower panel 28 to the side panels 14, 16 and glue flap 40 to completely tear, whereby the first, upper panel 4 of the container 48 moves downward onto or into close contact with second panel 28. If side panels 14, 16, glue flap 40 and end guide flaps 22, 24 are thought of as a skirt 124 around the upper panel 4, it should be appreciated that the skirt 124 has been moved in the direction F and, therefore, that the frictional contact between the container 48 and the pipette support 120 has been increased, as has the penetration of pipette tips 104 in the pipette support 120. Thus, when laboratory personnel engage the pipette tips 104 with equipment, the tendency for the container 48 to move or be upset relative to the support 120 will be reduced. Moreover, the pipette tips 104 remain in the apertures of the upper panel 4 so that the entire array of pipette tips 104 can be removed from the pipette support 120 when the pipette tips 104 are to be discarded or moved elsewhere.

Both the blank 2 and the blank 50 are preferably made from paperboard. Other sheet materials of similar stiffness combined with some flexibility, such as light plastics, could also be used.

The primary benefits and advantages of the invention in regard to ease of handling and insertion of pipette tips 104 into pipette support 120 and in regard to effectiveness of protective packaging of the pipette tips 104 are equally present in an alternative embodiment of the invention in which both the container 48 and the bottom receptacle 100 are present, but the first and second array holding panels 4,28 are not joined by collapsible spacing means. In this embodiment, the fold lines 34, 36 are scored and may be perforated but are not designed to be frangible. A number of other variations of the present invention can be made. For example, enclosures 100 of various sizes may be provided to provide a pipette tip receiving cavity 102 that may accommodate pipette tips 104 of various lengths. Likewise, when the container 48 is completed, the space between the first array holding panel 4 and the second array panel 28 might be varied by varying the width of the sidewalls or spacers 14, 16 and the guide flaps 22, 24. While container 48 is most suitably formed to provide a rectangular array of openings 46, other container shapes, such as circular or hexagonal could be used and adapted to fit the shape of corresponding pipette supports 120. The paperboard from which the present invention is fabricated may be of any suitable composition and may be coated with appropriate substances to impart desireable characteristics, such as resistance to liquids. Various other methods might be used to lock the shipping enclosure 100 into the closed position shown in FIG. 9; such methods include use of various adhesives or systems of interlocking tabs. The completed package containing the pipette tips 104 (FIG. 9) may be overwrapped with thermoplastic sheet material or other suitable materials. Of course, both the interior and exterior of the completed package may be marked with appropriate indicia and may be provided with other features such as tear strips or slots to facilitate the handling and opening of the box.

It should be understood that as an alternative to assembling the two blanks (as shown in FIGS. 1 and 4) into the two completed components of the package as shown in FIG. 7, the producer may provide the blanks 2,50 in a completely flat, unerected condition, partially erected or fully erected as shown in FIG. 7. Thus, the purchaser of the pipette unitizing and shipping container of the present invention has the option of how to purchase the package; if the purchaser purchases the blanks in flat condition, instruction may be provided on how to form the packaged condition for receiving its contents.

Although the description of the preferred embodiment has been presented, it is contemplated that various changes, included those mentioned above, could be made without deviating from the spirit of the present invention. It is therefore desired that the present embodiment be considered in all respects as illustrative, not restrictive, and that reference be made to the appended claims rather than the foregoing description to indicate scope of the invention.

What is claimed and desired to be protected by Letters Patent is:

1. A container for holding a plurality of elongated objects upright in a predetermined array pattern, comprising:

an upper array holding panel having a plurality of openings therethrough in a predetermined array pattern;

a lower array holding panel lying beneath, substantially parallel to and spaced from said upper array holding panel, said lower array holding panel having a plurality of openings therethrough that substantially match in vertical alignment and in array pattern the plurality of openings in the upper array holding panel; and collapsible spacing means connected between said upper and lower array holding panels for holding said panels in aligned, spaced relation until frangible connections in said spacing means are fractured by compressive force exerted on the upper and lower array holding panels causing them to move toward each other.

2. The container of claim 1 wherein said spacing means comprise side panels connected to said lower array holding panel at frangible connections that, when fractured, permit the upper and lower array holding panels to move toward each other.

3. The container of claim 2 wherein the container is made of paperboard and the frangible connections are located at fold lines between the lower array holding panel and the side panels, said fold lines being weakened and made frangible in response to said compressive force by cuts in the paperboard.

4. The container of claim 1 further comprising a pair of opposed end guide flaps, each said end guide flap being connected to the upper array holding panel at a fold line and extending downward from said fold line.

5. The container of claim 4 wherein the container is made of paperboard and the spacing means comprises opposed side panels extending between and generally perpendicular to the end guide flaps and between and generally perpendicular to the lower and upper array holding panels, each said side panel being connected between said lower and upper array holding panels at a pair of parallel fold lines, a first fold line lying between each side panel and the upper array holding panel and a second fold line lying between each side panel and the lower array holding panel, said second fold line being weakened and made frangible in response to said compressive force by cuts in the paperboard to form said frangible connection.

6. The container of claim 4 wherein each end guide panel extends downward below the lower array holding panel to form a pair of support legs for the container.

7. The container of claim 6, further comprising a base enclosure receptacle, said base enclosure receptacle being sized to snugly contact the end guide flap support legs and to form an enclosure beneath the lower array holding panel.

8. A container for holding a plurality of elongated objects upright in a predetermined array pattern, comprising:

a pair of substantially parallel, opposed end guide panels;

an upper array holding panel connected to and extending between and being perpendicular to said end guide panels and having a plurality of openings therethrough in a predetermined array pattern;

a lower array holding panel extending between and perpendicular to said end guide panels and lying beneath and parallel to the upper array holding panel, said lower array holding panel having a plurality of openings therethrough that substantially match in vertical alignment and in array pattern the plurality of openings in the upper array holding panel, said lower array holding panel being connected to said upper array holding panel by collapsible spacing means for holding said panels in aligned, spaced relation until said spacing means are fractured by a compressive force exerted on said upper and lower array holding panels, causing them to move toward each other.

9. The container of claim 8 wherein said spacing means comprise side panels connected to said lower array holding panel at frangible connections that, when fractured in response to said compressive force, permit the upper and lower array holding panels to move toward each other.

10. A flat blank for forming a tray for holding a plurality of elongated objects comprising:

a first generally rectangular array holding panel having a plurality of openings therethrough in a predetermined pattern and two pairs of opposed perimeter edges;

a pair of side panels attached to one of the pairs of opposed perimeter edges of said first array holding panel;

a pair of end guide flaps attached to the other pair of opposed perimeter edges of said first array holding panel;

a second generally rectangular array holding panel having two pairs of opposed perimeter edges and a plurality of openings therethrough in a predetermined pattern, said second array holding panel being detachably attached to one of said side panels along one of the perimeter edges of said second array holding panel, said second array holding panel being substantially equal in surface area and outline to said first array holding panel;

a glue flap detachably attached to said second array holding panel at the perimeter edge of said second array holding panel opposite the perimeter edge attached to one of said side panels; and two pairs of end tabs, each said pair of end tabs comprising extensions of one of said side panels and being foldably connected to one of said sidewalls at fold lines substantially collinear with those perimeter edges of the first array holding panel at which the end flaps are attached.

11. The blank according to claim 10, wherein said first array holding panel and said second array holding panel comprise an array of holes whereby, when the perimeters of said panels are collinear, the array of holes on the respective panels are in substantial alignment.

12. The blank according to claim 11, wherein said side panels and said end guide flaps are connected to said first array holding panel at fold lines and said second array holding panel is connected to one of said side panels at a fold line parallel to the fold line connecting said one side panels to the first array holding panel, whereby said blank may be folded into a tray configuration with said first and second array holding panels lying in spaced, parallel relationship with the side panels extending therebetween, the thickness of said tray being defined by the width of said side panels.

13. The tray according to claim 10, wherein said first and second array holding panels are of substantially equal size and each has substantially the same predetermined pattern of openings.

14. The blank according to claim 10 wherein said second array holding panel and said glue flap are connected to said blank by frangible fold lines whereby said second array holding panel may be separated from said blank along said frangible fold lines.

15. The blank according to claim 10 wherein said end tabs have cooperatively interlocking hook-shaped ends.

16. A two-part container for holding a plurality of elongated objects upright in a predetermined array pattern comprising:

a first container part comprising an upper array holding panel having a plurality of openings therethrough in a predetermined array pattern;

a lower array holding panel lying beneath and spaced from said upper array holding panel, said lower array holding panel having a plurality of openings therethrough that substantially match in vertical alignment and in array pattern the plurality of openings in the upper array holding panel; and spacing means connected between said upper and lower array holding panels for holding said panels in aligned, spaced relation until frangible connections in said spacing means are fractured by a compressive force exerted on said upper and lower array holding panels causing them to move toward each other; and a second container part comprising an open-topped box having a base panel and a pair of substantially parallel support flaps extending substantially vertically upward from said base panel, for engaging said first container part and supporting it above said base panel with said upper array holding panel lying substantially parallel to said base panel and spaced therefrom to define a cavity between said base panel and said first container part into which the elongated objects may extend.

17. The two part container of claim 16 wherein said first container part has a generally rectangular box shape and has a set of interengaging end flaps, each set including an end guide flap and a pair of end tabs, at each of two opposed ends of the rectangular box shape and one of said support flaps of said second container is inserted to lie adjacent the flaps of each of said set of interengaging end flaps.

18. The two part container of claim 17 wherein the end guide flap associated with each set of interengaging end flaps of said first container part is an interior end guide flap extending downward from said first container part toward said base and each of said support flaps engages and lies adjacent to a surface of each interior end guide flap that faces the cavity.

19. The two part container of claim 18 wherein each of said support flaps engages the surface of the upper array holding panel that faces the lower array holding panel.

20. The two part container of claim 16 wherein said upper and lower array holding panels are substantially parallel to each other and said spacing means comprises collapsible spacing means for holding the upper and lower array holding panels in aligned, spaced, parallel relation, said spacing means being connected to said lower array holding panel at frangible connections that, when fractured, permit the upper and lower array holding panels to move toward each other.

* * * * *